United States Patent [19]

Brauch

[11] Patent Number: 4,526,118

[45] Date of Patent: Jul. 2, 1985

[54] STITCH LENGTH CONTROL DAMPENING ARRANGEMENT FOR A SEWING MACHINE

[75] Inventor: Robert B. Brauch, Wayne, N.J.

[73] Assignee: The Singer Company, Stamford, Conn.

[21] Appl. No.: 653,166

[22] Filed: Sep. 24, 1984

[51] Int. Cl.[3] ..... D05B 3/04; D05B 27/00

[52] U.S. Cl. ..... 112/315; 112/316; 188/380; 248/569; 248/636; 267/140.1

[58] Field of Search ..... 112/315, 316, 314, 317; 248/569, 568, 636; 188/380; 267/140.1, 140.3, 136

[56] References Cited

U.S. PATENT DOCUMENTS

| | | | |
|---|---|---|---|
| 3,895,408 | 7/1975 | Leingang . | |
| 4,032,202 | 6/1977 | Ishikawa et al. . | |
| 4,033,533 | 7/1977 | Evrard . | |
| 4,373,708 | 2/1983 | Costa | 267/136 |
| 4,499,839 | 2/1985 | Blackwood et al. | 112/317 |

FOREIGN PATENT DOCUMENTS

| | | | |
|---|---|---|---|
| 79679 | 3/1960 | France | 188/380 |
| 544789 | 3/1977 | U.S.S.R. | 267/136 |

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

Vibrational movements of a spring biased lever, which is selectively positionable by a stitch length control lever and controls the operation of feed regulating mechanism in a sewing machine accordingly, are dampened by the operation of a plunger that is carried by said control lever and has a camming surface thereon to engage and lift the spring biased lever when the control lever is moved.

5 Claims, 5 Drawing Figures

STITCH LENGTH CONTROL DAMPENING ARRANGEMENT FOR A SEWING MACHINE

BACKGROUND OF THE INVENTION

1. Field of the Invention

The invention relates to stitch length control mechanism for a sewing machine.

2. Description of the Prior Art

Sewing machines are commonly provided with stitch length control mechanism. Such mechanism may include a stitch length control lever in association with a pivoted lever which is spring biased against a camming surface on the stitch length control lever and operably connected to feed regulating mechanism of the kind shown for example in U.S. Pat. No. 3,527,183, of Jan Szostak for "Work Feeding Mechanism for Sewing Machines", issued Sept. 8, 1970. The stitch length control lever may then be used to selectively position the spring biased lever and thereby control operation of the feed regulating mechanism. However, the feed regulating mechanism in such an arrangement tends to impart vibrational movements to the spring biased lever. This causes the spring biased lever to impact repetitively against the stitch control lever and produce an unacceptable amount of noise.

It is a prime object of the present invention to eliminate objectionable noise in stitch length control mechanism for a sewing machine.

It is another object of the invention to dampen impact noise in a sewing machine between a stitch length control lever and a pivoted spring biased lever which is operably connected to feed regulating mechanism in the machine.

Other objects and advantages of the invention will become apparent during a reading of the specification taken in connection with the accompanying drawings.

SUMMARY OF THE INVENTION

A sewing machine according to the invention includes feed regulating mechanism, a pivoted lever operably connected with the feed regulating mechanism, a stitch length control lever, and a spring which biases said pivoted lever toward the stitch length control lever. The stitch length control lever includes a low friction plunger with a camming surface which engages the spring biased lever, and which, in response to movement of the stitch length control lever, positions the spring biased pivoted lever to control operation of the feed regulating mechanism and thereby stitch length. The stitch length control lever is provided with a resilient shock absorber under the plunger to dampen vibrations of the spring biased pivoted lever as occassioned by operation of the feed regulating mechanism.

DESCRIPTION OF THE PREFERRED EMBODIMENT

Figure 1:
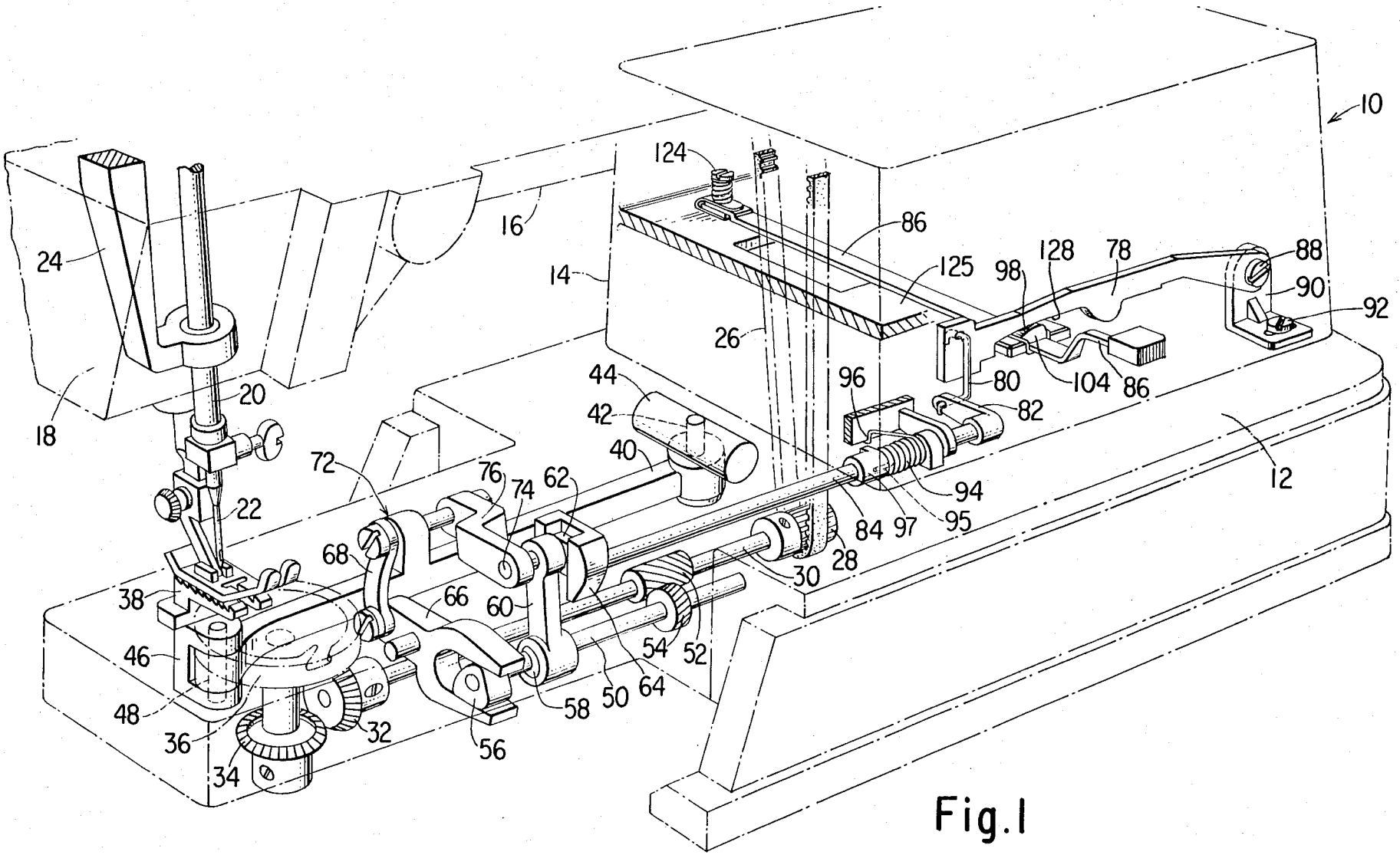
FIG. 1 is a perspective view showing stitch length control mechanism according to the invention.
Figure 2:
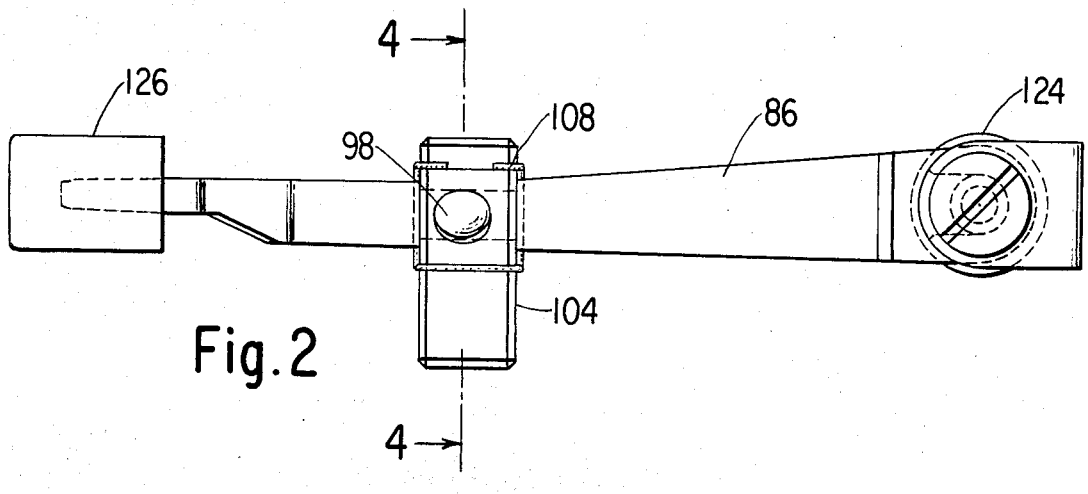
FIG. 2 is a top plan view of a stitch length control lever according to the invention.
Figure 3:
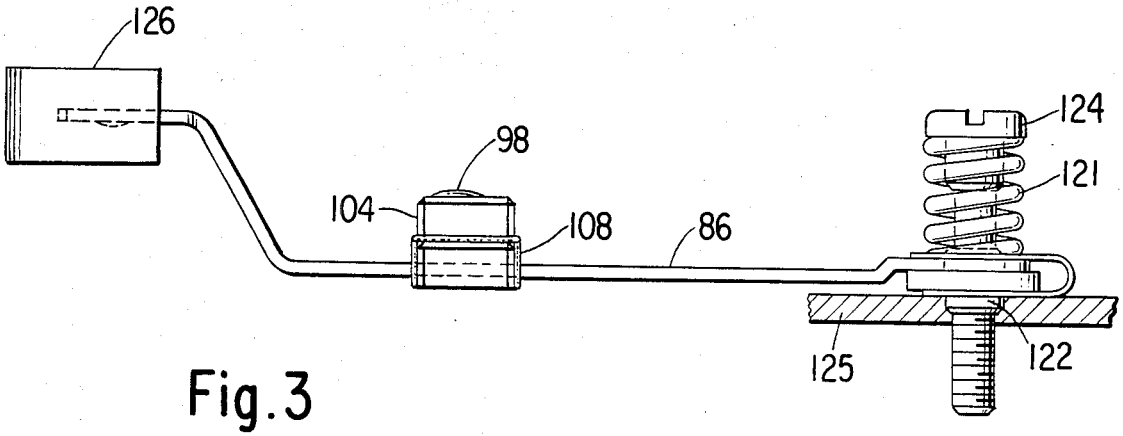
FIG. 3 is an elevational view of the stitch length control lever.
Figure 4:
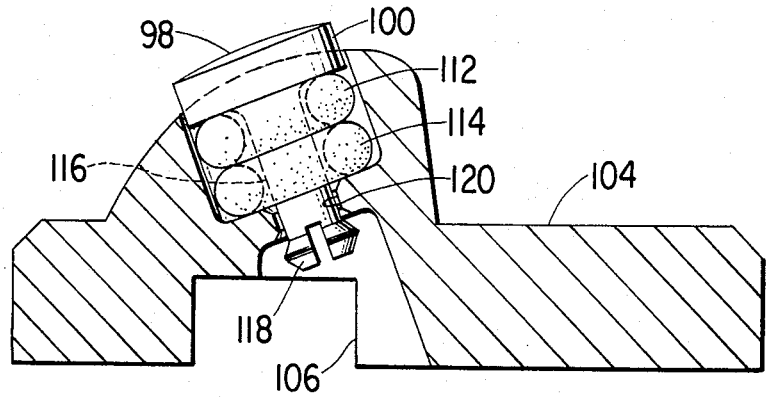
FIG. 4 is a sectional view on the plane of the line 4—4 of FIG. 2 showing a cam assembly for use on the stitch length control lever.
Figure 5:
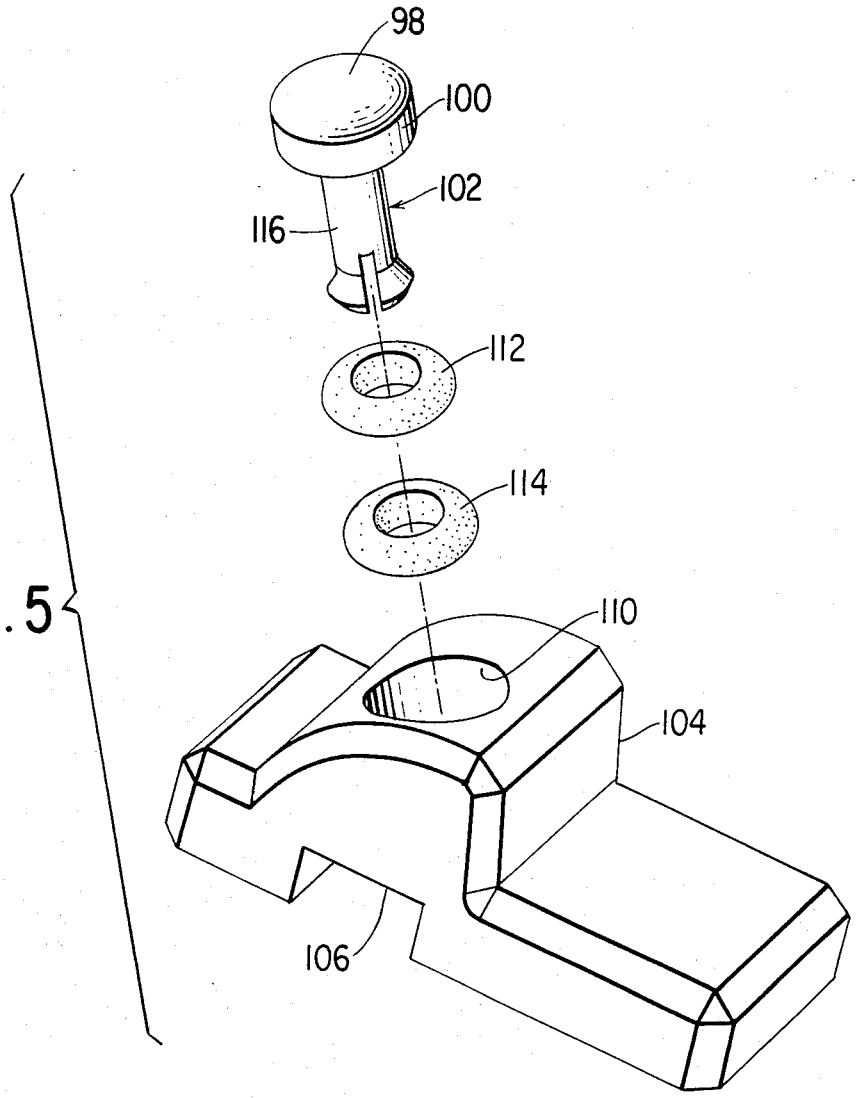
FIG. 5 is an exploded perspective view of the cam assembly.

Referring to the drawings, reference character 10 generally designates a sewing machine including a bed 12, a standard 14 rising from the bed, and a bracket arm 16 projecting from the standard to overhang the bed. The bracket arm terminates in a sewing head 18 wherein a needle bar 20 having a needle 22 attached thereto is supported for endwise reciprocation in a needle bar gate 24. The gate is preferably mounted for pivotal movement in head 18 to accommodate lateral jogging of the needle 22 by bite controlling mechanism which may be of the type shown for example, in U.S. Pat. No. 4,188,895, of R. E. Johnson for "Needle Bight Control Mechanism", issued Feb. 19, 1980. Conventional needle bar driving mechanism (not shown) for imparting endwise reciprocation to the needle operably connects through a timing belt 26, sprocket 28, bed shaft 30 and bevel gears 32 and 34 with a looptaker 36 which is driven in timed relation to the operation of the needle.

Work is movable under the needle 22 by a feed dog 38 which is controlled by feed regulating mechanism of the type disclosed in U.S. Pat. No. 3,527,183, of Jan Szostak for "Work Feeding Mechanisms For Sewing Machines". As shown, such feed regulating mechanism includes a feed bar 40 which is mounted at shafts 42 and 44 so that it may be oscillated in mutually perpendicular directions to impart vertical and horizontal motion to the feed dog, the feed dog being carried by a bracket 46 that is secured to a pivot pin 48 journalled in the feed bar. The feed regulating mechanism also includes a shaft 50 which is driven by bed shaft 30 through gears 52 and 54, a lift cam 56, a feed advance eccentric 58 in a pitman 60, a slide block 62, and a feed regulating block 64. The lift cam imparts vertical motion to the feed bar through a bifurcated lever 66, a link 68, and a pin and boss assembly indicated generally by reference numeral 72. Transverse motion is imparted to the feed bar by means of the feed advance eccentric 58, pitman 60, a pivot pin 74, slide block 62, feed regulating block 64 and a link 76. Such transverse motion, and therefore stitch length as well as feed direction, is determined according to the position of feed regulating block 64. The block is positionable by a lever 78 acting through links 80 and 82, and a rock shaft 84 to which the block is affixed. Lever 78 is positionable by a stitch length control lever 86.

As shown, lever 78 is pivoted at 88 on a bracket 90 which is affixed in the bed of the machine with a screw 92. A spring 94 having one end 96 restrained in the machine, and the other end 95 affixed in a collar 97 which is attached to rock shaft 84 biases lever 78 downwardly into engagement with a camming surface 98 which is fixedly located on the stitch length control lever 86. The camming surface 98 is formed on the head 100 of a plastic plunger 102 which is located in a carrier 104 having a recess 106 on the underside thereof. The carrier straddles control lever 86 at recess 106 and is secured thereto with a resilient strap 108. Plunger 102 extends into a well 110 in carrier 106, as shown, and is resiliently supported therein by two O-rings 112 and 114 of elastomeric material located under head 100 and extending about the neck 116 of the plunger. A bifurcated enlarged end 118 of neck 116 extending through a restricted opening 120 in the carrier retains the plunger 102 in well 110.

Stitch length control lever 86 is pivoted at one end under a spring 121 on the shoulder 122 of a screw 124 which is affixed in a platform 125. The opposite end of the lever 86 carries a knob 126 for use in moving the control lever about its pivotal axis, which is perpendicular to the pivotal axis of lever 78, to position camming surface 98 along the length of an engaging curvilinear undersurface 128 of spring biased lever 78. By pivotally moving control lever 86, an operator can select a position for lever 78 and thereby control the operation of the feed regulating mechanism to determine stitch length. The length of the stitch length control lever between its pivotal axis and camming surface 98 is of a length which is sufficient to prevent disengagement of surfaces 98 and 128 throughout control movements of lever 86.

Vibrational forces are imparted to lever 78 by the feed regulating mechanism during operation of the machine, and cause the lever to impact against camming surface 98 on plunger 102. However, undue noise resulting from such impacts is prevented both by operation of the plunger and by the sound deadening nature of the materials used in the plunger, O-ring assembly. The plunger is of a plastic material, such as "Delrin" or "Celcon", having a low friction coefficient enabling the plunger head 100 to slide easily on the wall of well 110 in carrier 104, and camming surface 98 to be moved with little frictional resistance across the undersurface 128 of lever 78; whereas the O-rings 112 and 114 are of an elastomeric shock absorbing material such as rubber or a urethane plastic, and as such resist downward movement of the plunger in well 110 to dampen the vibration of lever 78.

It is to be understood that the present disclosure relates to a preferred embodiment of the invention which is for purposes of illustration only and is not to be construed as limiting the invention. Numerous alterations and modifications of the structure herein disclosed will suggest themselves to those skilled in the art, and all such modifications and alterations which do not depart from the spirit and scope of the invention are intended to be included within the scope of the appended claims.

I claim:

1. In a sewing machine, feed regulating mechanism, a pivoted lever operably connected with the feed regulating mechanism, a stitch length control lever, a spring which biases said pivoted lever toward the stitch length control lever, the stitch length control lever including a low friction plunger with a camming surface which engages said pivoted lever and which in response to movement of the stitch length control member positions the pivoted lever to control operation of the feed regulating mechanism, said stitch length control lever also including a resilient shock absorber under the plunger to dampen vibrations of said pivoted lever occassioned by the operation of the feed regulating mechanism.

2. The combination of claim 1 wherein the plunger is of a low friction plastic material and the shock absorber is of an elastomeric material.

3. The combination of claim 1 wherein the stitch length control lever extends under said pivoted lever, and the spring biases the pivoted lever downward toward the stitch length control lever.

4. The combination of claim 1 wherein said stitch length control lever is pivoted and the pivotal axes of the stitch length control lever and the other lever extend in mutually perpendicular directions.

5. The combination of claim 1 wherein said shock absorber is a ring of elastomeric material.

* * * * *